US008446109B2

(12) United States Patent
Yang

(10) Patent No.: US 8,446,109 B2
(45) Date of Patent: May 21, 2013

(54) LED LIGHT SOURCE WITH DIRECT AC DRIVE

(75) Inventor: Long Yang, Livermore, CA (US)

(73) Assignee: Bridgelux, Inc., Livermore, CA (US)

( * ) Notice: Subject to any disclaimer, the term of this patent is extended or adjusted under 35 U.S.C. 154(b) by 0 days.

(21) Appl. No.: 13/084,336

(22) Filed: Apr. 11, 2011

(65) Prior Publication Data

US 2012/0091920 A1 Apr. 19, 2012

(51) Int. Cl.
*G05F 1/00* (2006.01)
*H05B 39/04* (2006.01)

(52) U.S. Cl.
USPC ..... 315/307; 315/291

(58) Field of Classification Search
USPC ..... 315/291, 307, 209 R, 312, 91, 185 R
See application file for complete search history.

(56) References Cited

U.S. PATENT DOCUMENTS 6,670,776 B2 * 12/2003 Guthrie et al. ..... 315/200 A
6,841,947 B2 * 1/2005 Berg-johansen ..... 315/169.3
7,708,447 B2 * 5/2010 Tobler et al. ..... 362/619
7,843,150 B2 * 11/2010 Wang et al. ..... 315/307
8,174,212 B2 * 5/2012 Tziony et al. ..... 315/309
2009/0187925 A1 * 7/2009 Hu et al. ..... 719/327
2011/0109244 A1 5/2011 Grajcar

OTHER PUBLICATIONS

International Search Report, PCT/US2012/021445 dated Dec. 3, 2012.

* cited by examiner

*Primary Examiner* — Minh D A
(74) *Attorney, Agent, or Firm* — Calvin B. Ward

(57) ABSTRACT

A light source and method for operating a light source are disclosed. The present invention includes a light source and method for using the same. The light source includes a power coupler, a reconfigurable two-dimensional LED array and a controller. The power coupler is configured to receive a power potential that varies as a function of time. The LED array has a plurality of configurations of LEDs, each configuration being characterized by a minimum bias potential and a maximum bias potential. The LED array generates light when a potential between first and second power terminals is greater than the minimum bias potential. The controller varies the configuration of the array such that the power potential remains between the minimum and maximum bias potentials as the power potential varies.

21 Claims, 15 Drawing Sheets

LED LIGHT SOURCE WITH DIRECT AC DRIVE

BACKGROUND OF THE INVENTION

Light-emitting diodes (LEDs) are an important class of solid-state devices that convert electric energy to light Improvements in these devices have resulted in their use in light fixtures designed to replace conventional incandescent and fluorescent light sources. The LEDs have significantly longer lifetimes and, in some cases, significantly higher efficiency for converting electric energy to light.

The conversion efficiency of individual LEDs is an important factor in addressing the cost of high power LED light sources. The conversion efficiency of an LED is defined to be the electrical power dissipated per unit of light that is emitted by the LED. Electrical power that is not converted to light in the LED is converted to heat that raises the temperature of the LED. The light conversion efficiency of an LED decreases with increasing current through the LED.

LEDs are typically powered from a DC power source or a modulated square wave source so that a constant current flows through the LED while the LED is "on". The current value is set to provide high conversion efficiency. In light sources with variable intensity, the intensity of the light is controlled by changing the duty factor of the modulated square wave so that the current flowing through the LED is at a value consistent with providing the desired efficiency.

Conventional lighting systems for use in buildings typically must be powered from an AC power source. Hence, an LED-based replacement light source typically includes an AC-DC power converter. The cost of the power converter represents a significant fraction of the cost of a typical LED light source. In addition, the power losses in the power converter reduce the overall efficiency of the light source. In addition, such AC-DC converters are not as reliable as that of LEDs, and hence, can limit the lifetime of the lighting system.

To avoid these costs, LED light sources that operate directly from an AC power source without the power first being converted to DC have been proposed. For example, light sources that include two strings of LEDs have been proposed. The LEDs are connected in series in each string. One string is powered on when the AC waveform is in the positive half of the sine wave, and the other is powered when the AC waveform is in the negative half of the sine wave. This simple driving scheme suffers from low efficiency and flicker. To improve the efficiency, light sources that include a full-wave rectifier have been proposed; however, such light sources still have low efficiency and exhibit flicker.

Consider a single LED that is driven by an AC waveform. In general, the LED is characterized by a turn-on voltage, $V_f$, which must be exceeded to forward bias the LED so that a substantial current will flow through the LED. The LED will remain off until the sine wave reaches this voltage. When the voltage is greater than this turn-on value, the LED will generate light; however, the voltage drop across the LED must also be maintained below a maximum value, $V_d$, at which the LED will be damaged. In general, the current through the LED increases exponentially with voltage above the turn-on voltage until the current is limited by the series resistance of the LED. Hence, the difference between the turn-on and maximum voltages that characterize the allowable operating range of the LED is relatively small. For example, $V_f$ is approximately 2.75V and $V_d$ is approximately 3.6V for GaN blue LEDs. $V_f$ is determined by the dominant wavelength of the emitting light. $V_d$ is determined by the overall heat consumption the packaged LEDs are capable of enduring or the highest current density allowed to the LEDs without causing long term reliability issues.

To accommodate the maximum voltage, $V_s$, of a typical building power source, a number of LEDs must be connected in series. The minimum number of diodes must be greater than $V_s/V_d$ to prevent damage to the LEDs unless a current limiting mechanism is included in the drive circuitry which consumes further power. For example, with the 110V AC system, the peak voltage is 156V, i.e., $V_s$=156V, approximately 43 LEDs must be placed in series to withstand the peak voltage. However, the string will cease to make light when the voltage drops to 118V. As a result, light is generated approximately 30 percent of the time. This leads to a 120-cycle flicker. In addition, the number of LEDs that must be used to generate a predetermined average light intensity is more than three times the number needed in a DC driving scheme, which increases both the component and the packaging costs.

In a co-pending application, U.S. Ser. No. 12/504,994, filed on Jul. 17, 2009, an improved AC LED light source is described in which each LED in a series string is connected in parallel with a switch that shorts that LED when the AC voltage across the string is insufficient to drive all of the LEDs in the string. By removing LEDs from the string when the AC voltage is below the voltage needed to drive all of the LEDs, the duty cycle is substantially increased. However, the resulting light intensity varies approximately sinusoidally. In addition, the light source will still cease to make light when the AC voltage falls below $V_f$. This "dark" period further increases the perception of a flickering source. Hence, the flicker problem remains. In addition, the average number of LEDs generating light over the cycle is still substantially less than 100 percent. Finally, the cost of the light source is increased by the number of switches needed to implement this scheme.

SUMMARY OF THE INVENTION

The present invention includes a light source and method for using the same. The light source includes a power coupler, a reconfigurable two-dimensional LED array and a controller. The power coupler is configured to receive a power potential that varies as a function of time. The reconfigurable two-dimensional LED array has a plurality of configurations of LEDs, each configuration being characterized by a minimum bias potential and a maximum bias potential. The LED array generates light when a potential between first and second power terminals is greater than the minimum bias potential. The controller measures the power potential when the power is received by the apparatus and reconfigures the LED array in response to the measured power potential such that the minimum bias potential of the chosen configuration is less than the power potential when the power potential is greater than a predetermined threshold value and such that the measured power potential is less than the maximum bias potential.

DETAILED DESCRIPTION OF THE PREFERRED EMBODIMENTS OF THE INVENTION

Normally, LEDs are driven by a constant current source that operates from a DC power supply. As noted above, the cost of the power source represents a significant portion of the overall cost of the light source. To avoid this cost, it has been suggested that LEDs could be operated directly from any AC power source. In such a scheme, a full-wave rectified AC power source is connected directly to the LED. Hence, the LED is driven by a power source that is no longer a constant current source. Since the current through an LED is an exponential function of the driving voltage at voltages above the minimum voltage, $V_f$, at which the LED will be turned on, care must be taken to make sure that the voltage does not reach a point at which the current through the LED will cause damage to the LED. In addition, it is useful to maintain the current below that at which the efficiency of the LED is reduced and too much heat is generated.

Figure 1:
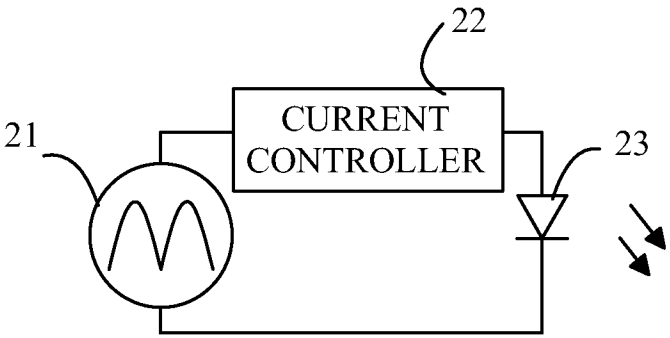
FIGURE 1 (PRIOR ART)
FIG. 1 illustrates an LED driven by a full-wave rectified power source.
Figure 2:
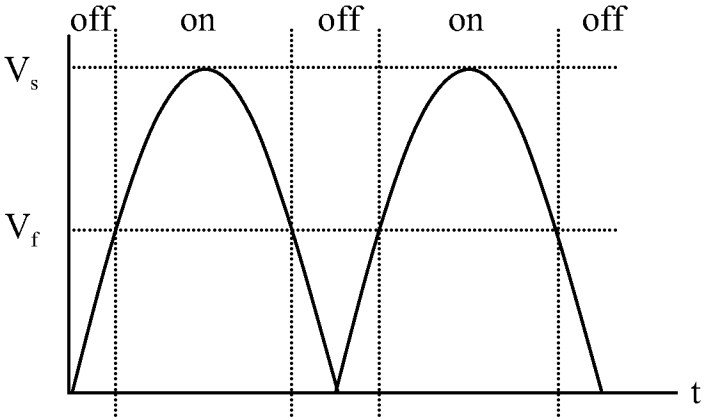
FIGURE 2 (PRIOR ART)
FIG. 2 illustrates two cycles of the full-wave rectified power source.

Referring now to FIG. 1, which illustrates an LED 23 driven by a full-wave rectified power source 21. Two cycles of the full-wave rectified power source are shown in FIG. 2. In general, LED 23 is characterized by a minimum forward voltage value, $V_f$, at which the LED passes current and generates light. Since the current through an LED like any other diode increases exponentially with the voltage across the diode above this minimum voltage, a current controller 22 is typically utilized to prevent the current through the LED from reaching a value that would destroy the LED direct operation. In operation, the LED is operated with a voltage across the LED, which is slightly higher than $V_f$. It should be noted that the value of $V_f$ can be altered by connecting a number of LEDs in series to produce an LED that effectively has a higher $V_f$. That is, LED 23 could be replaced by N serial connected LEDs in which case the effective $V_f$ would be N times the $V_f$ of the individual LEDs. Hence, a full-wave rectified 110V source can be used for power source 21.

Refer now to FIG. 2. The LED will generate light when the voltage of the waveform is greater than $V_f$. At the points in the power cycle in which the voltage of the driving waveform is less than $V_f$, no light is generated, and hence, the light source flickers with a frequency of twice the AC line frequency. The amount of time that the light source is off depends on the relative values of $V_p$ and $V_f$. Increasing $V_p$ relative to $V_f$ lowers the fraction of the time that the light source is off. However this leads to wasted power since the voltage that is not applied across the LED appears across the current controller to protect the LED. The power that is not converted in the LED is converted to heat in the current controller. Hence, increasing $V_p$ relative to $V_f$ to increase the fraction of the time the light source is on leads to significant power losses.

Figure 3:
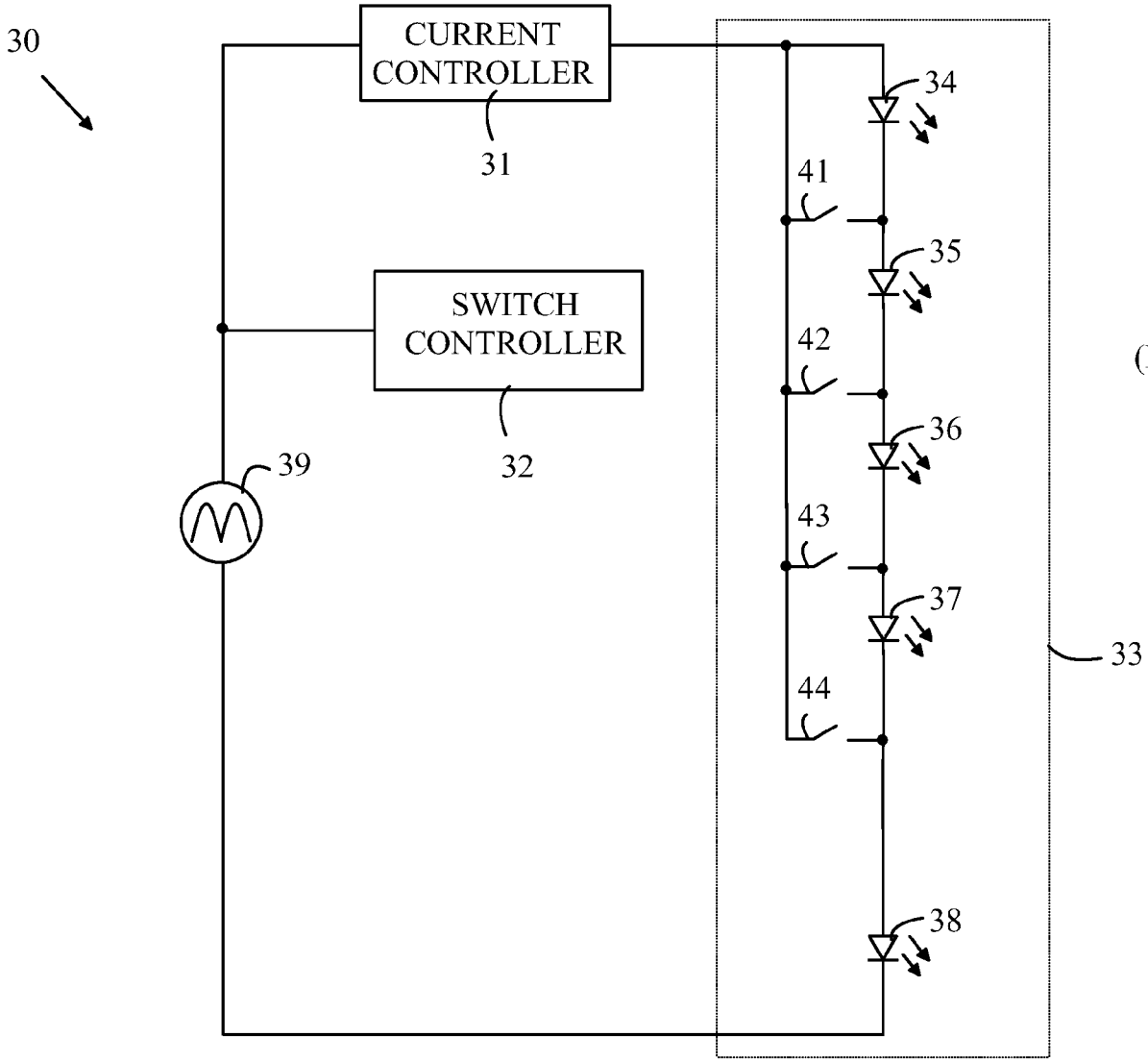
FIGURE 3 (PRIOR ART)
FIG. 3 is a schematic drawing of a light source that utilizes a series connected string of LEDs with shorting switches.

In the above-identified co-pending application, a scheme that reduces these power losses is described. In one of these embodiments, the LED shown in FIG. 2 is replaced by a series connected string of LEDs with shorting switches that effectively remove LEDs from the string in response to the drops in the power voltage of the AC waveform. Referring now to FIG. 3, which is a schematic drawing of a light source 30 that utilizes a series connected string of LEDs. Series connected string of LEDs 33 is powered from a fully rectified AC source 39 through a current controller 31. In the embodiment shown in FIG. 3, the series connected string of LEDs consists of five LEDs shown at 34 through 38. A number of shorting switches shown at 41 through 43 are used to control which LEDs in the string are active at any given time. For example, if shorting switch 41 is closed, LED 34 is no longer powered. Similarly if shorting switch 42 is closed, LEDs 34 and 35 are no longer powered. A switch controller 32 controls which of the switches are activated at any given time based on the voltage of the waveform from its source 39.

In operation, the switches are operated as follows: When the voltage from source 39 is less than two $V_f$, switch 44 is closed and the remaining switches are in the open position. As the voltage increases about two $V_f$, switch 44 is opened and switch 43 is closed thereby applying the voltage across LEDs 37 and 38. When the voltage increases further to at least three V, switch 42 is closed and the remaining switches are set in the open position and hence the voltage is applied across LEDs 36, 37, and 38. This process continues until the voltage from source 39 is greater than five $V_f$. At this point, all of the switches are open and the voltage appears across the entire series string of LEDs. As the voltage decreases from its peak voltage, the process is repeated in reverse.

The embodiment shown in FIG. 3 suffers from flicker. The flicker is the result of the large variations in light intensity over the power cycle. In addition, the flicker is further enhanced by the total lack of light when the driving voltage falls below $V_f$. The fraction of the time that the light source is off depends on the ratio of the peak voltage from voltage source 39 to $V_f$.

Figure 4:
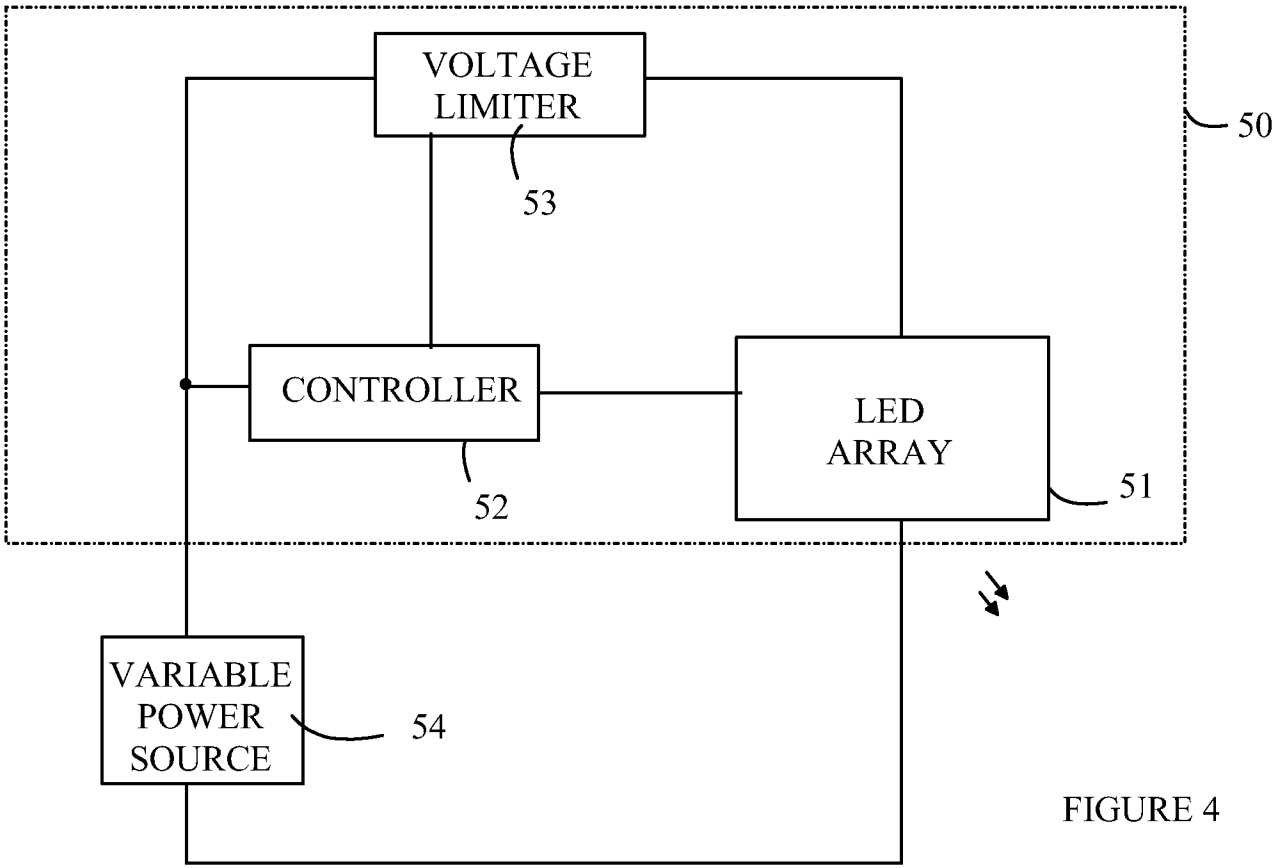
FIG. 4 illustrates one embodiment of a light source according to the present invention.

Refer now to FIG. 4, which illustrates one embodiment of a light source according to the present invention. Light source 50 includes a two-dimensional array of LEDs 51 that is driven from a variable power source 54. Array 51 includes a number of switches that allow the connection arrangement of the LEDs within the array to be changed by controller 52 in response to variations in the output voltage of power source 54. An optional voltage limiter 53 prevents the voltage across array 51 from reaching a value that would damage the LEDs within array 51.

The details of the switching system will be discussed in more detail below. For the purposes of the present discussion, array 51 includes N LEDs. For any given configuration of the LEDs, the array can be viewed as a single LED with a minimum voltage, $V_{min}$, below which light will not be generated and a maximum voltage, $V_{max}$, that must not be exceeded. The output light intensity for any given configuration is approximated by the number of LEDs that are on in that configuration. Ideally, controller 52 reconfigures the array such that three conditions are met. First, as the voltage from the power source varies over the power cycle, $V_{min}$ should be adjusted such that $V_{min}$ is less than the output voltage of power source 54 so that light will be generated throughout the power cycle. Ideally, for an array of identical LEDs, the array should be capable being configured such that $V_{min}$ changes in increments of $V_f$ from $V_f$ through $NV_f$. Since the array must always have at least one LED connected between its power terminals if the array is to generate light, $V_{min}$ cannot be decreased below $V_f$.

Second, $V_{max}$ for the array should be adjusted such that $V_{max}$ is greater than the output voltage to ensure that the LEDs will not be damaged. It should be noted that voltage limiter 53 could be utilized to prevent damage to the LEDs; however, relying on voltage limiter 53 for this function results in a loss of efficiency, since the excess power is dissipated in the current controller.

Figure 5:
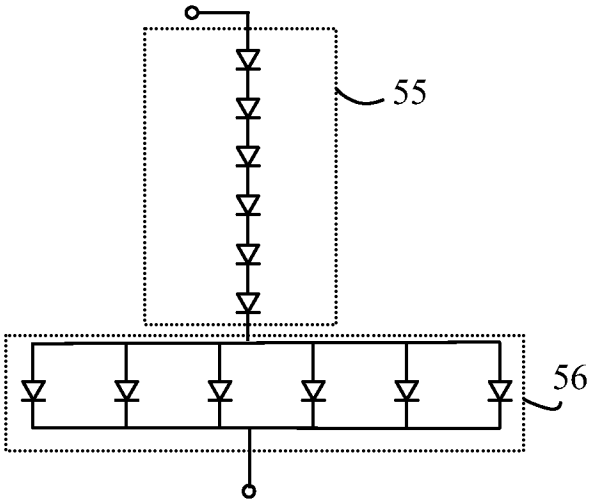
FIG. 5 is a schematic drawing of a two-dimensional array of LEDs consisting of two sub-arrays.

Third, configurations in which the current through the various LEDs in the arrays varies greatly from one LED to another should be avoided. This problem is illustrated in FIG. 5, which is a schematic drawing of a two-dimensional array of LEDs consisting of two sub-arrays. Sub-array 55 consists of six-LEDs in series, and sub-array 56 consists of six LEDs in parallel. The two sub-arrays are connected in series. The two dimensional array has a $V_{min}=7V_f$. Each LED can be viewed as consisting of an ideal diode in series with a resistor. The current passing through the LEDs in sub-array 55 must be six times the current passing through the LEDs in sub-array 56. Hence, the resistive power loss in the LEDs in sub-array 55 is 36 times higher than that in the LEDs in sub-array 56. The high power loss in the LEDs of sub-array 55 leads to excessive heating of those LEDs, and, in addition, results in lower efficiency of conversion of electrical power to light. Accordingly, configurations in which one LED is required to carry more than 6 times the current of another LED in the array when both LEDs are conducting current are preferably avoided. In one aspect of the invention, configurations in which one LED is required to carry more than 3 times the current of another LED in the array are avoided.

To simplify the following discussion, it will be assumed that all of the LEDs in the array have the same $V_f$, and $V_d$. In this case, $V_{min}$ must be an integer multiple of $V_f$. Hence, an array that could be configured such that $V_{min}$ can be set in increments of $V_f$ would be advantageous. Denote the voltage from power supply 54 at any given time, t, by $V_p(t)$. Ideally, controller 52 would configure array 51 such $V_{min}<V_p(t)\leqq V_{min}+V_f$. For each configuration, there is a $V_{max}$ corresponding to that configuration. As will be discussed in more detail below, there will be cases in which $V_p(t)>V_{max}$ for every possible configuration for some short period of time. In such instances, voltage limiter 53 can be used to reduce the voltage that actually appears across the array by splitting the voltage limiter 53 and array 51 until V(t) returns to a safe value.

In one aspect of the invention, the LED array is constructed from a plurality of LED modules such that resulting configurations can provide $V_{min}$ values from $V_f$ to $NV_f$ for an array having N LEDs. The manner in which this is achieved can be more easily understood with reference to FIGS. 6(*a*)-6(*d*), which illustrate four configurations of a six-LED array that have different $V_{min}$ values. To simplify the drawing, the switches used to configure the array have been omitted. The switching network will be discussed in more detail below. The highest $V_{min}$ value is $6V_f$ and corresponds to the arrangement shown in FIG. 6(*a*). The arrangement shown in FIG. 6(*b*) provides a $V_{min}$ of $3V_f$, and the arrangement shown in FIG. 6(*c*) provides a $V_{min}$ of $2V_f$. Finally, the arrangement shown in FIG. 6(*d*) has a $V_{min}$ of $V_f$. It should be noted that in all of these arrangements, all six LEDs generate light provided the voltage across the array is at least $V_{min}$.

Figure 6:
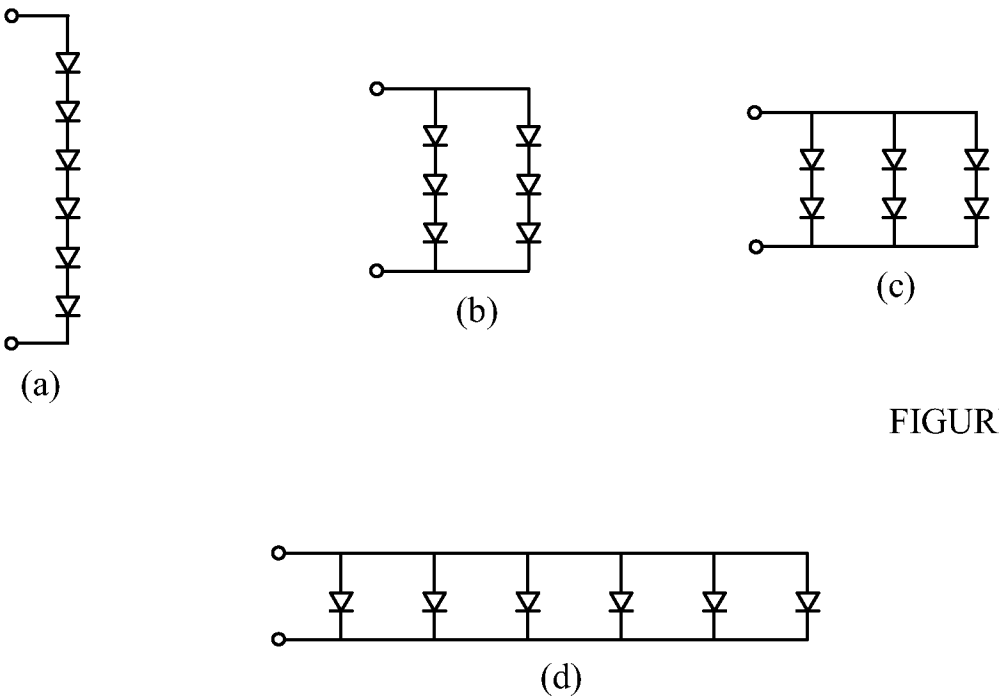
FIGS. 6(*a*)-6(*d*) illustrate four configurations of a six-LED array that have different $V_{min}$ values.
Figure 7:
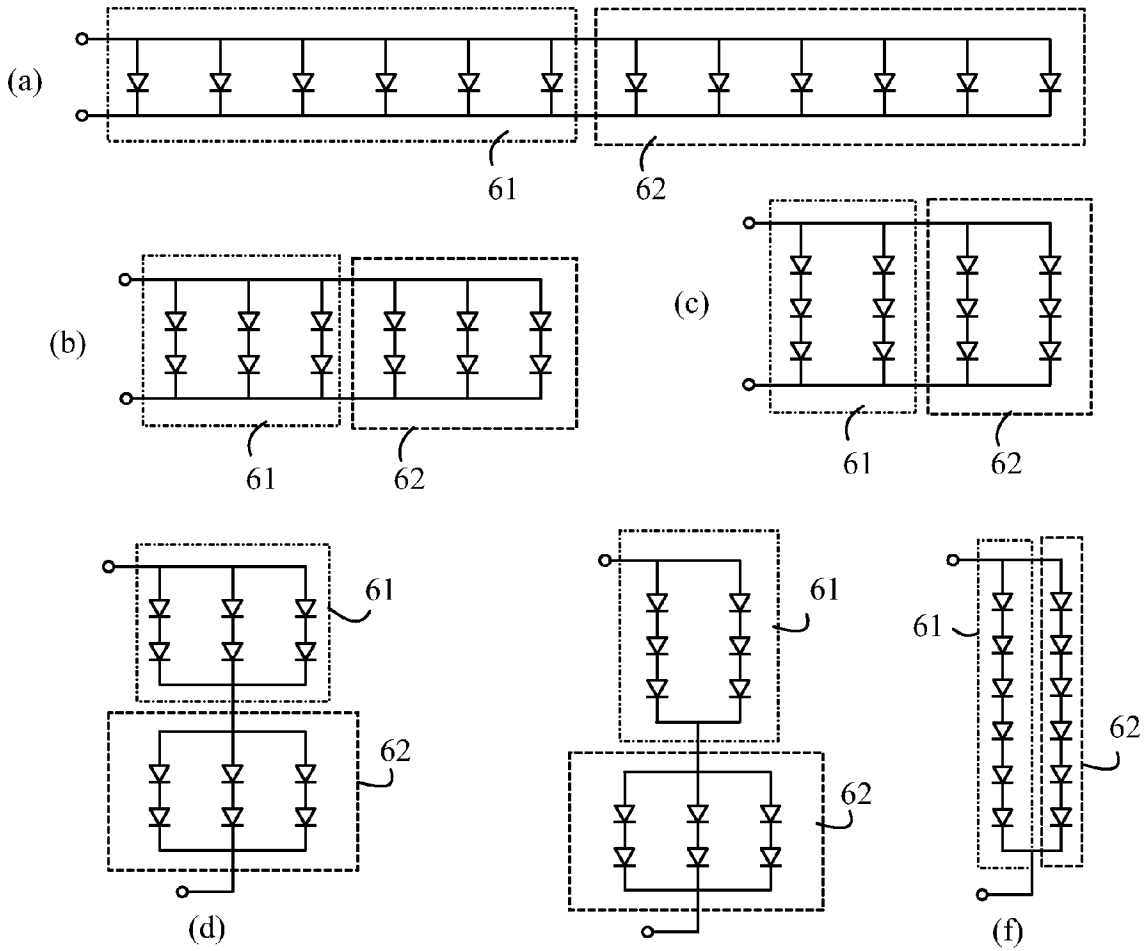
FIGS. 7(*a*)-7(*f*) illustrate the arrangements of the two sub-arrays that provide the $V_{min}$ values in question.
Figure 8C:
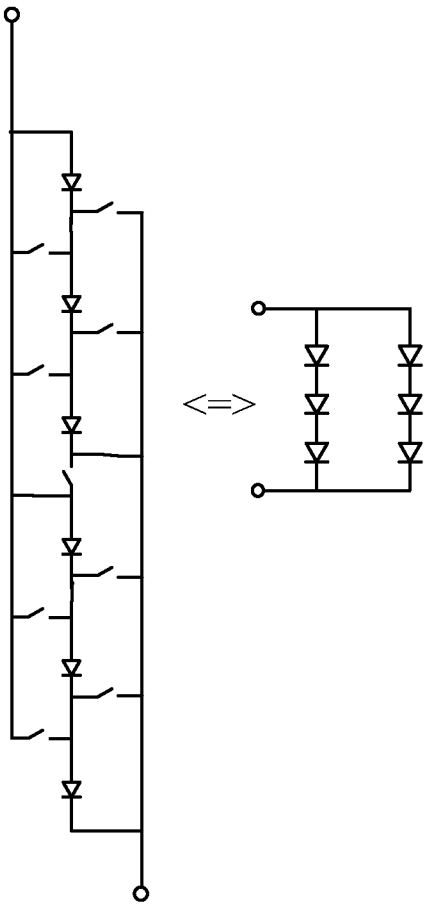
FIGS. 8(*a*)-8(*e*) illustrate one embodiment of a sub-array according to the present invention in which the sub-array has six LEDs that are connected with various switches.
Figure 8B:
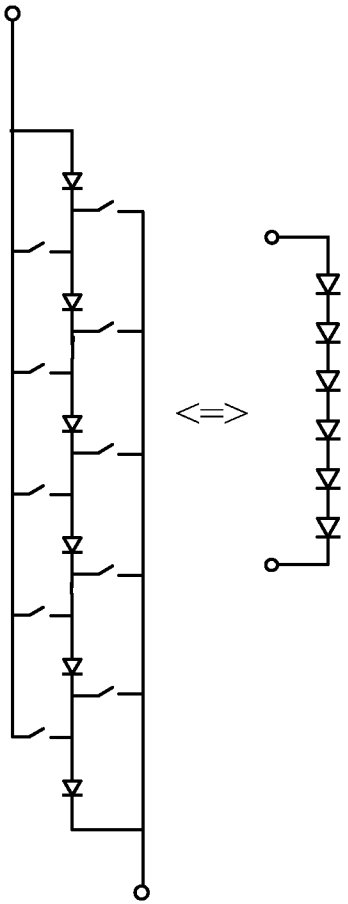
Figure 8A:
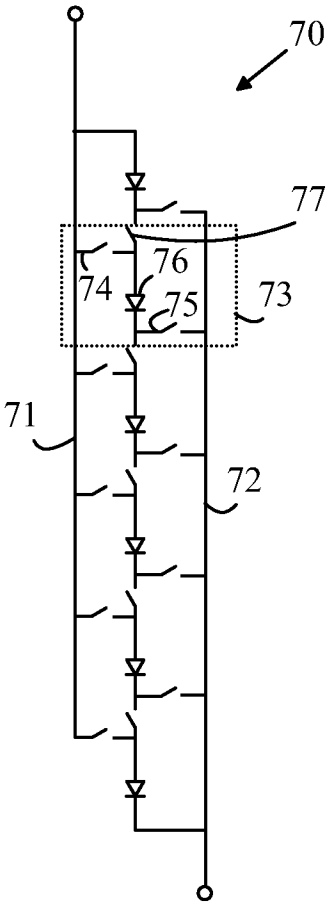
Figure 8E:
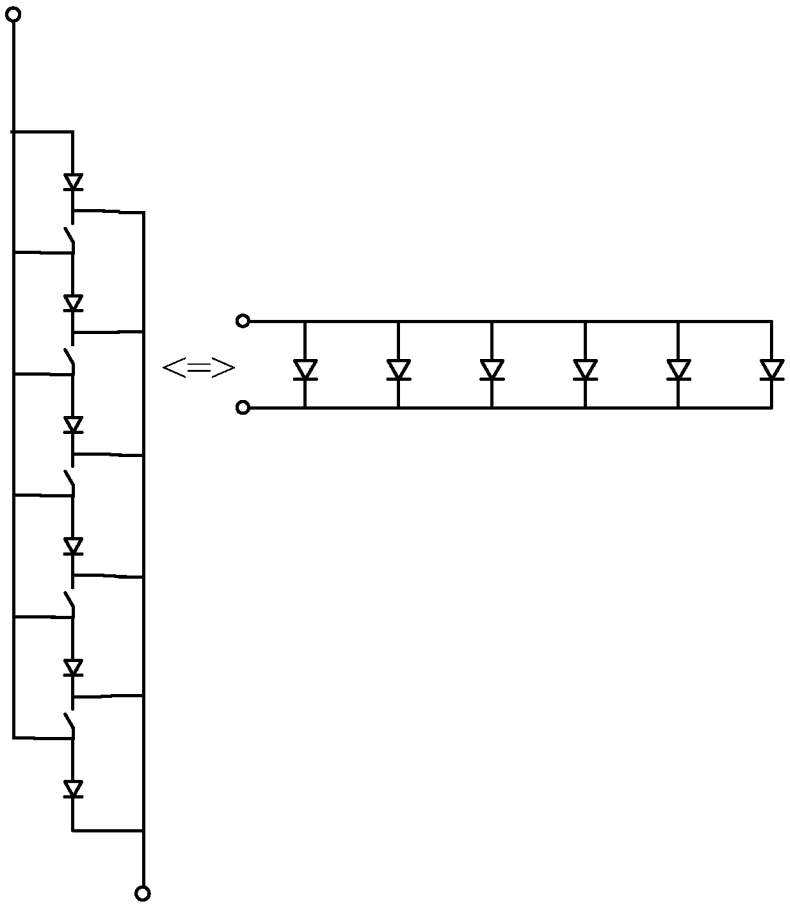
Figure 8D:
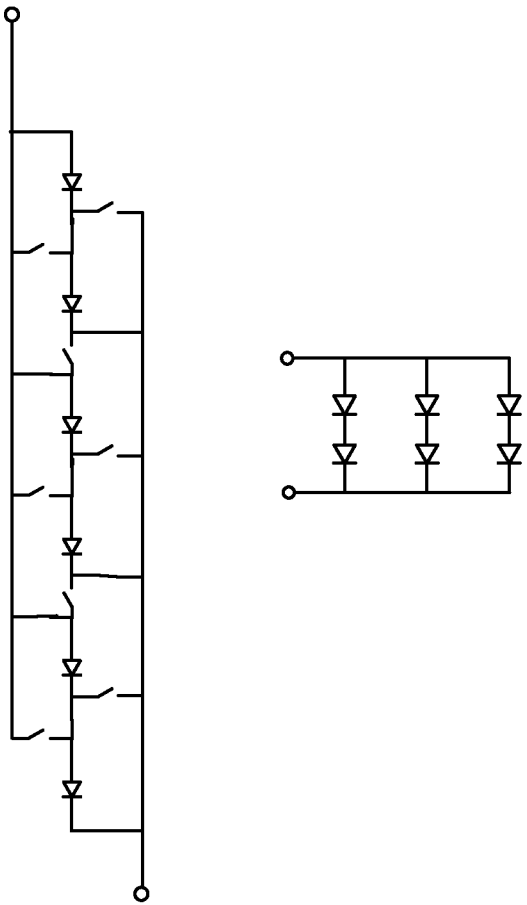

It should be noted that the single six-LED array shown in FIG. 6 cannot provide an array with a $V_{min}$ of $4V_f$ or $5V_f$ and still have all of the LEDs generating light at the same time. However, an array constructed from two such six-LED sub-arrays can provide all $V_{min}$ values from $V_f$ to $6V_f$. Refer now to FIGS. 7(*a*)-7(*f*), which illustrate the arrangements of the two sub-arrays that provide the $V_{min}$ values in question. To provide a $V_{min}=V_f$, the two arrays shown at 61 and 62 are each configured as a 1×6 LED array as shown in FIG. 7(*a*). To provide $V_{min}=2V_f$, the arrays are configured as 2×3 arrays and connected in parallel as shown in FIG. 7(*b*). Similarly, the two arrays provide a $V_{min}=3V_f$ when connected as 3×2 arrays and driven in parallel as shown in FIG. 7(*c*). If the two arrays are connected as 2×3 arrays and driven in series, a $V_{min}=4V_f$ is obtained as shown in FIG. 7(*d*). To provide a $V_{min}=5V_f$, array 61 is configured as a 2×3 array, and array 62 is configured as a 3×2 array. The two sub-arrays are then driven in parallel as shown in FIG. 7(*e*). Finally, a $V_{min}=6V_f$ is obtained by configuring the two arrays as 6×1 arrays and driving the sub-arrays in parallel as shown in FIG. 7(*f*).

It should be noted that in all of these configurations, all 12 LEDs generate light whenever the input voltage is greater than the $V_{min}$ value for that configuration. In all of the configurations except that shown in FIG. 7(*e*), all of the LEDs are driven with the same current assuming that the LEDs are identical. In the case of the arrangement shown in FIG. 7(*e*), the LEDs in sub-array 61 must pass 150 percent of the current that flows through each of the LEDs in sub-array 62. However, this arrangement still satisfies the limitations discussed above, and hence, this does not present a problem. The problems associated with balancing the currents through each of the LEDs in more complicated two-dimensional arrays will be discussed in more detail below.

Refer now to FIGS. 8(*a*)-8(*e*), which illustrate one embodiment of a sub-array according to the present invention in which the sub-array has six LEDs that are connected with various switches. FIG. 8(*a*) is a schematic drawing of one embodiment of a sub-array having six LEDs. Sub-array 70 is constructed from a plurality of LED sections, including a first section, a number of intermediary sections and a last section. An exemplary intermediate section is shown at 73. Section 73 includes an LED 76 and three switches. Switch 74 connects the anode of LED 76 to a first power rail 71. Switch 75 connects the cathode of LED 76 to a second power rail 72. Switch 77 connects the anode of LED 75 such that section 73 can be connected in series to the section above it in the sub-array. The first section lacks switches 74 and 76. The last section lacks switch 75. By setting the positions of the switches, various two-dimensional configurations of LEDs can be obtained. FIG. 8(*b*) illustrates the switch positions used to obtain six LEDs in series. Similarly, FIG. 8(*c*) illustrates the switch positions that provide two sets of three LEDs in series that are connected in parallel to the power terminals. FIG. 8(*d*) illustrates the switch positions that provide three sets of LEDs in which each set has two LEDs in series, and the three sets are connected in parallel across the power terminals. Finally, FIG. 8(*e*) illustrates the switch positions that provide six LEDs in parallel across the power terminals.

Referring again to FIG. 8(*a*), each of the LEDs in sub-array 70 could be replaced by another sub-array of LEDs. For example, each LED could be replaced by a similar array having six LEDs that can assume the configurations shown in FIG. 6. The resulting array would have 36 LEDs, and could withstand a voltage of approximately 130V.

As noted above, the ideal LED array would have configurations that can be changed such that the minimum driving voltage, $V_{min}$, could be varied in increments of $V_f$. However, not all of these configurations are needed in many light sources of interest, particularly when the driving voltage is at its highest values during the voltage cycle. Consider a voltage source that consists of a full-wave rectified 110V AC power source. As noted above, approximately 44 LEDs in series are needed to withstand the peak voltage of 156V, assuming $V_d$ for each LED is 3.6V. That is, at the peak voltage, the array is configured as 44 LEDs in series ($V_{min}$=44$V_f$, and $V_{max}$=44$V_d$). This array will function in this configuration between 121V and 158V. Sometime before voltage from the source decreases below 121V, the array must be reconfigured to have a lower $V_{min}$.

There are a number of different configurations that can be used for the next configuration. The next configuration must have a $V_{max}$ of at least 121V and a $V_{min}$ that is less than 121V. Hence, the next configuration must present a load that has at least 34 LEDs in series, i.e., $V_{min}$=34$V_f$, and $V_{max}$=34$V_d$. Any configuration that has $V_{min}$ between 34$V_f$ and 43$V_f$ could be utilized. The source voltage at which the switch occurs to the new configuration will depend on the choice of $V_{min}$. In one aspect of the invention, the choice of the configuration depends on the array satisfying the additional rules discussed above. For example, if one configuration does not utilize all of the LEDs in the array and a second of the possible configurations uses all of the LEDs, the second configuration would be preferred if that configuration does not require that the current through one of the LEDs exceed a predetermined design current, such as the factor of six rule discussed above.

It should also be noted that when the $V_{min}$ value is large compared to $V_f$, turning off one or two LEDs to provide the desired $V_{min}$ results in very little loss in intensity from the light source, and hence, may be acceptable. If $V_{min}$ is less than 20$V_f$ for the current driving voltage, turning off an LED is less attractive, since the light source intensity would be reduced significantly.

When $V_{min}$<$V_f$, no light will be provided by any configuration of the LED array. When $V_{min}$<$V_f$, there will not be any configuration in which the LEDs are ON. When $V_{min}$ is small but greater than $V_f$, there will be periods in which no configuration will satisfy all of the conditions discussed above.

Consider the case in which the LED array is configured with $V_{min}$=3$V_f$, i.e., there are three LEDs in series, with a number of such strings connected in parallel. For the $V_f$ and $V_d$ values discussed above, $V_{min}$=8.25V and $V_{max}$=10.8V for this configuration. When the voltage from the source decreases to below $V_{min}$, the LED array must be reconfigured. The next configuration has $V_{min}$=2$V_f$ and $V_{min}$=$V_f$, and $V_{max}$=7.2V. There are three possible choices of action in this case. First, the array could be dark for voltage values between 8.25V and 7.2V. This would be accomplished by not switching the configuration until the voltage from the source is less than $V_{max}$ of the next configuration, i.e., 7.2V. The second possibility would be to violate the condition that V must be less than $V_{max}$ for the period of time in question. The damage done to the LEDs by subjecting the LEDs to voltages in excess of $V_d$ is the result of heating in the LEDs. In some cases, the LEDs could be overloaded for a period of time that is small compared to the duty cycle without permanent damage, since the excess heat would be dissipated during the remainder of the cycle.

The third possibility is to use voltage limiter 53 shown in FIG. 4 to limit the voltage at the LED array. In this case, the excess power is dissipated in voltage limiter 53 and all of the LEDs will remain ON. In one aspect of the invention, the voltage limiter 53 provides a variable voltage limiting function under the control of controller 52. Controller 52 stores a table of $V_{max}$ values for each configuration. When controller 52 configures LED array 51 such that $V_{max}$ would be violated, controller 52 causes voltage limiter 53 to take part of the voltage across voltage limiter 53 to maintain the voltage at LED array at $V_{max}$ or slightly lower.

Figure 9:
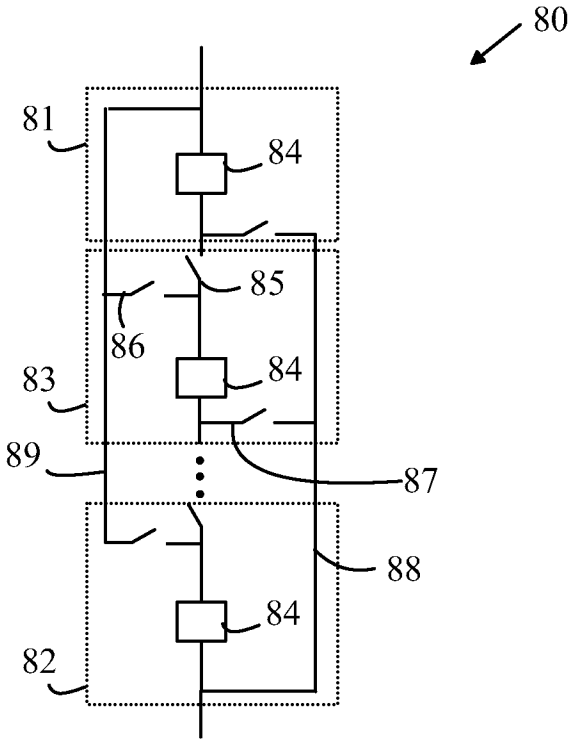
FIG. 9 illustrates the basic connection arrangement utilized in a nested two-dimensional array.

The above-described embodiments require a two-dimensional array of LEDs that can be configured in various series and parallel arrangements to provide an array that has a $V_{min}$ and a $V_{max}$ that can be adjusted in response to changes in the voltage across the array. In one aspect of the present invention, such an array is constructed from a nested arrangement of sub-arrays having a topology that is analogous to that shown in FIG. 8(*a*). Refer now to FIG. 9, which illustrates the basic connection arrangement utilized in a nested two-dimensional array. Array 80 is constructed from a plurality of sections including a first section 81, a last section 82, and optionally, a number of intermediate sections 83. Refer first to intermediate section 83. Intermediate section 83 includes a light source 84 and three switches 85-87. Switch 86 connects the anode of light source 86 to power rail 89; switch 87 connects the cathode of light source 84 to power rail 88, and switch 85 connects the anode of light source 84 to the cathode of the light source in the adjacent stage. Section 81 differs from section 83 in that switches 85 and 86 are omitted. Similarly, section 82 differs from section 83 in that switch 87 is omitted.

The nested arrangement can be used to connect the light sources in various series and parallel arrangements, in a manner analogous to that described above with reference to FIGS. 8(*a*)-8(*e*). In addition, one or more of the light sources could be turned off by bypassing the light source in a manner similar to that described above with reference to FIG. 3. In this regard, it should be noted that the light source in FIG. 8(*a*) is an example of this topology with six sections and each light source being a single LED. However, each of the light sources in array 80 could include another light source having the topology of 80. Hence, the outer levels of the nested array can be used for connecting various sub-arrays in parallel and series combinations by utilizing the sub-arrays for the light sources shown at 84.

Refer again to FIGS. 7(*a*)-(*f*). The various configurations of the 12 LED light sources shown in FIG. 7 can be achieved by using a nested light source, in which the outermost arrangement has two stages, i.e., the first and last stages shown in FIG. 9. Each light source 84 in the outermost configuration consists of a 6-LED light source constructed from another nested light source with six sections in which each section has a single LED as the internal light source in that section. These 12-LED light sources can then be used as light sources 84, a nested light source in which the outermost arrangement has eight stages to provide a 96-LED light source, and so on. The resultant 96-LED light source is well adapted for use with a full-wave rectified 120V AC power source or a 240V AC full-wave rectified power source.

Figure 10C:
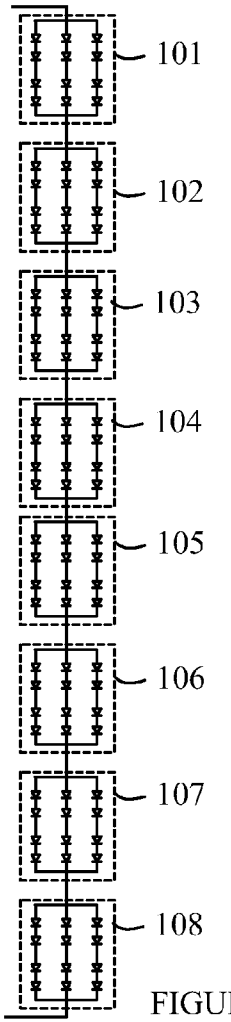
FIGS. 10(*a*)-10(*p*) and Table 1 illustrate the 15 configurations of a 96-LED light source that are needed to track a 120V full-wave rectified power source.
Figure 10B:
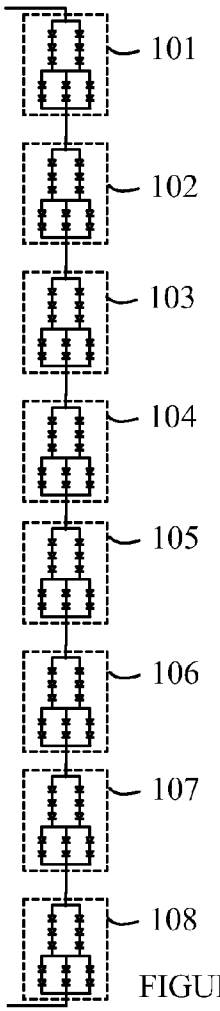
Figure 10A:
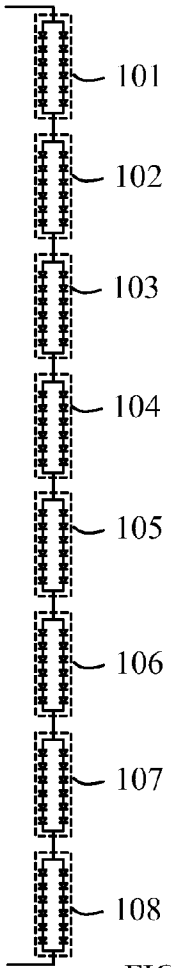
Figure 10E:
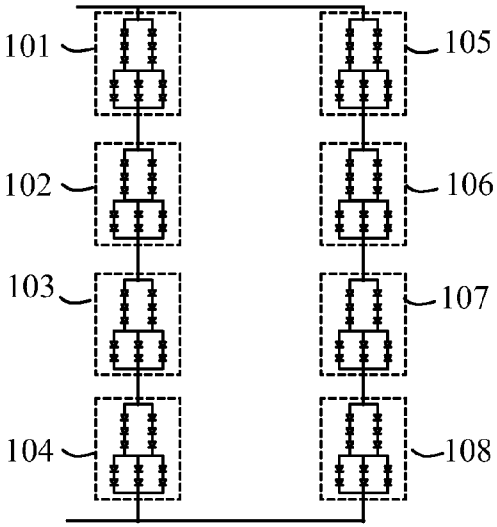
Figure 10D:
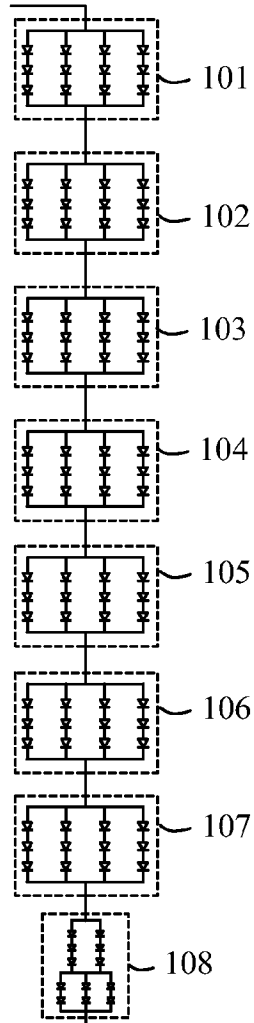
Figure 10G:
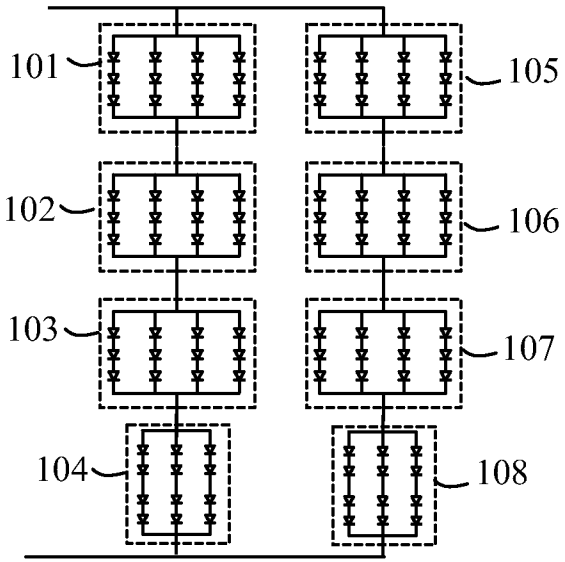
Figure 10F:
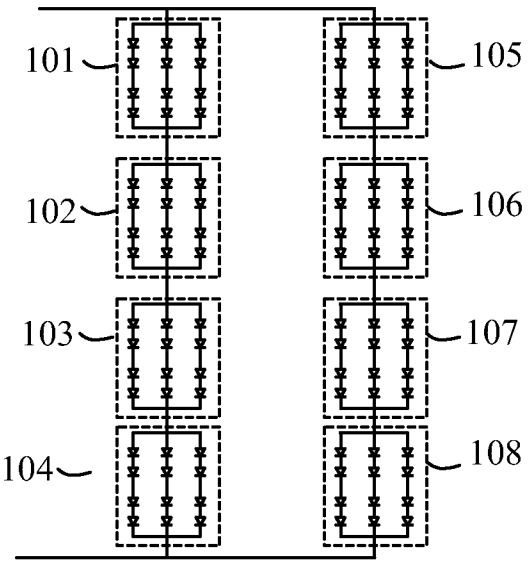
Figure 10I:
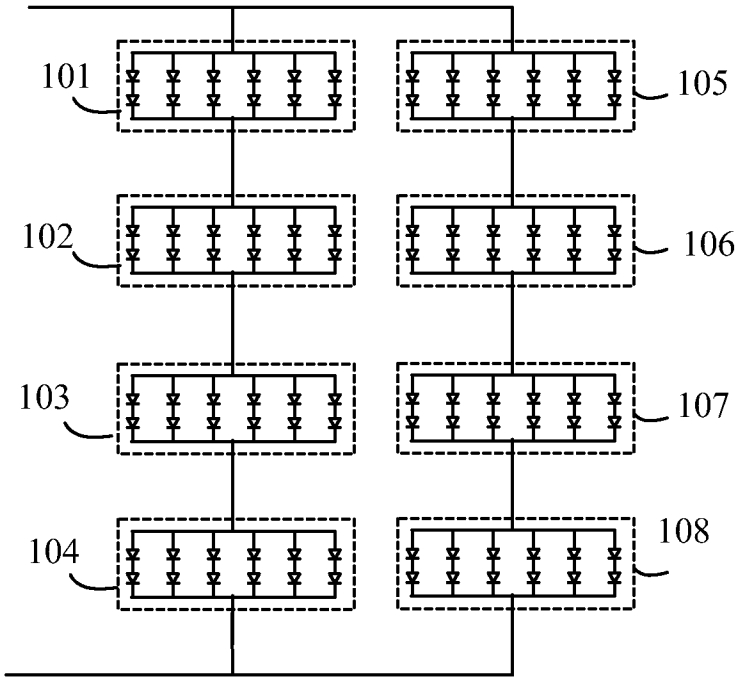
Figure 10H:
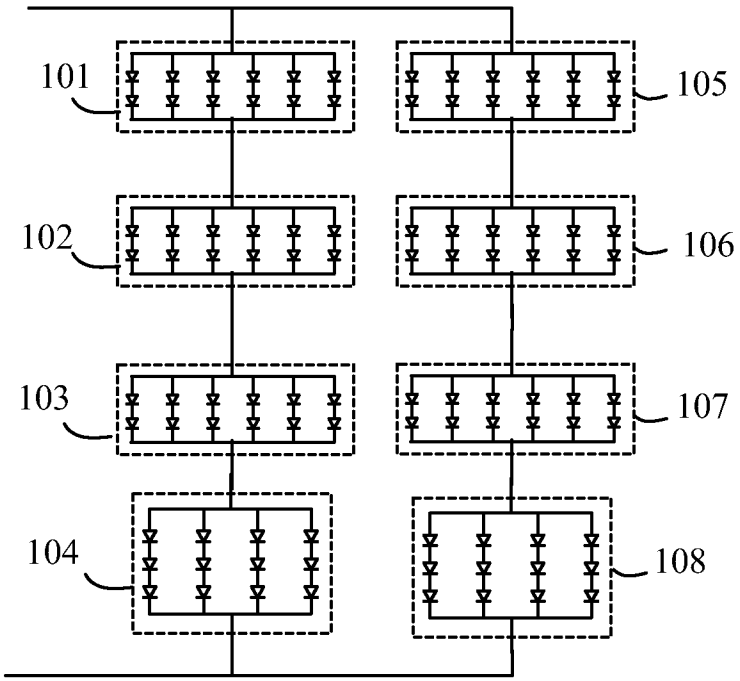
Figure 10J:
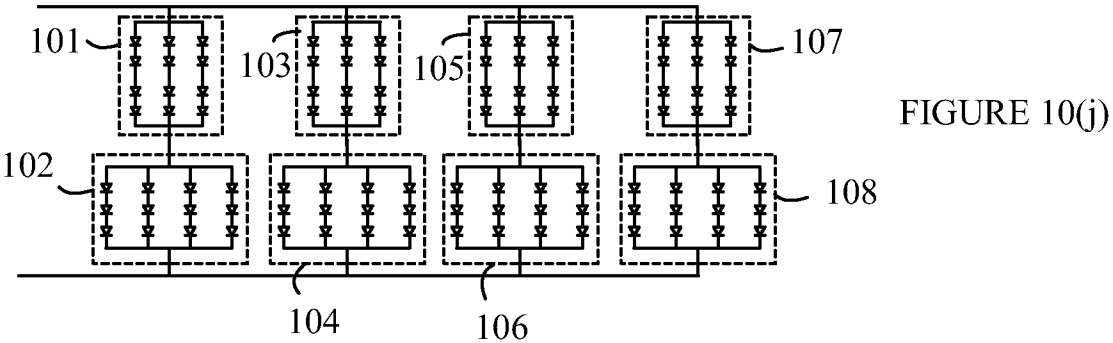
Figure 10K:
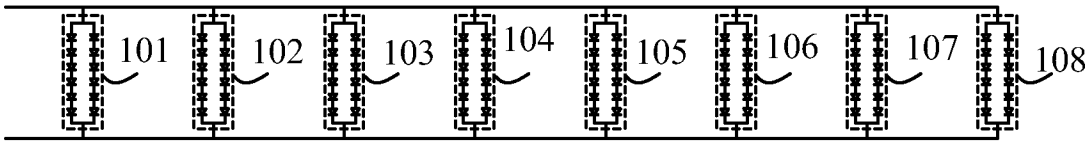
Figure 10L:
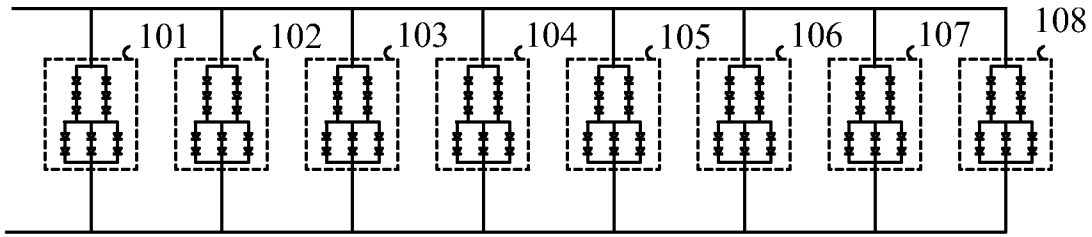
Figure 10M:
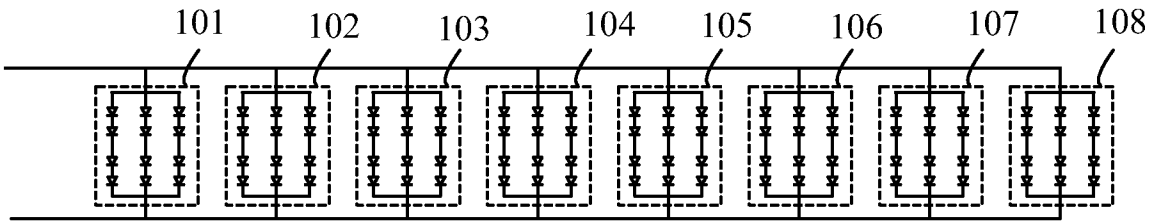
Figure 10N:
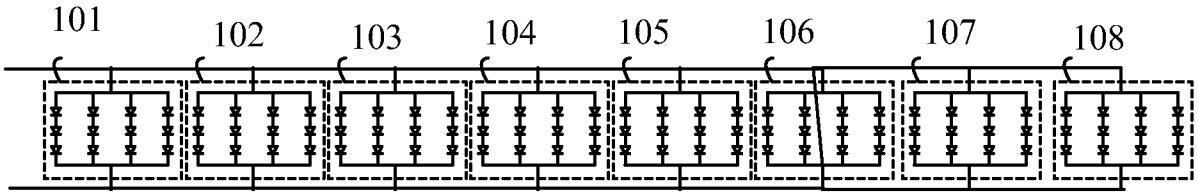
Figure 10:
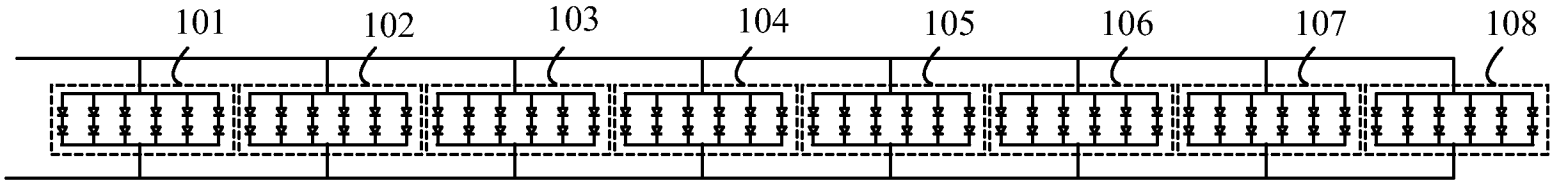
Figure 10P:
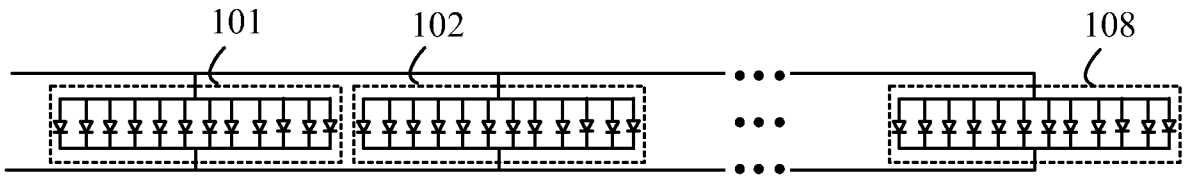

Refer now to FIGS. 10(*a*)-10(*p*) and Table 1, which illustrate the 15 configurations of such a 96-LED light source that are needed to track a 120V full-wave rectified power source. The light source can be viewed as eight sub-arrays in which each sub-string has 12 LEDs. As noted above, the peak voltage of such a light source is approximately 156V. As discussed above, each configuration is characterized by a $V_{max}$ and a $V_{min}$ voltage between which the array will generate light from the LEDs therein without damaging the LEDs. $V_{min}$ is $N_s$*$V_f$, where $N_s$ is the number of LEDs that are connected in series between the power terminals of the array. Similarly $V_{max}$ is $N_s$*$V_d$. In the following discussion, it will be assumed that the source voltage starts at the peak voltage. Each configuration covers one voltage range characterized by the $V_{min}$ and $V_{max}$ values. The initial voltage range is shown as configuration 1 in Table 1 and illustrated in FIG. 10(*a*). The connection scheme for configuration consists of two 48-LED strings connected in series. The eight sub-arrays are shown at

101-108. The explanations of the remaining 14 configurations will be evident from Table 1 and the associated figures.

TABLE 1

Configurations for 120 V AC source

| Config. | $V_{max}$ | $V_{min}$ | # of LEDs in series | Figure |
|---|---|---|---|---|
| 1 | 172.8 | 132 | 48 | 10(a) |
| 2 | 144 | 110 | 40 | 10(b) |
| 3 | 115.2 | 88 | 32 | 10(c) |
| 4 | 93.6 | 71.5 | 26 | 10(d) |
| 5 | 72 | 55 | 20 | 10(e) |
| 6 | 57.6 | 44 | 16 | 10(f) |
| 7 | 46.8 | 35.75 | 13 | 10(g) |
| 8 | 36 | 27.5 | 10 | 10(h) |
| 9 | 28.8 | 22 | 8 | 10(i) |
| 10 | 25.2 | 19.25 | 7 | 10(j) |
| 11 | 21.6 | 16.5 | 6 | 10(k) |
| 12 | 18 | 13.75 | 5 | 10(l) |
| 13 | 14.4 | 11 | 4 | 10(m) |
| 14 | 10.8 | 8.25 | 3 | 10(n) |
| 15 | 7.2 | 5.5 | 2 | 10(o) |
| 16 | 3.6 | 2.75 | 1 | 10(p) |

The switching between configurations can occur at any source voltage, V, between $V_{max}$ of the next configuration and $V_{min}$ of the previous configuration. Hence, the controller can switch the array from configuration 1 to configuration 2 at any source voltage between 132V and 144V. With the exceptions of the transitions from configuration 14 to configuration 15, and from configuration 15 to configuration 16, the states can be switched without turning off the LEDs or damaging the LEDs due to over voltage.

There are three methods for dealing with the exceptions discussed above. The first method is to delay switching configurations. For example, if the voltage from the source is decreasing, the transition could be delayed until the voltage is within the $V_{min}$-$V_{max}$ range of the destination state. If the voltage from the source is increasing, the transition could be made as soon as the voltage is outside the $V_{min}$-$V_{max}$ range of the originating configuration. This approach will result in the array going dark for a short period of time between transitions. The length of that dark period will be discussed in more detail below.

The second method is to use voltage limiter 53 shown in FIG. 4 to reduce the voltage across the array such that the transition can be made as soon as the voltage is out of the range of the originating configuration. In this case, a small amount of power will be dissipated in voltage limiter 53 during the transition. However, the amount of power is small compared to the average power dissipated by the light source over the power cycle. Hence, this arrangement is acceptable in many applications.

Third, the LED array could be subjected to an over voltage condition for a short time period. The damage done to the array when $V_d$ is exceeded results primarily from the heating of the LEDs by the extra current that flows through the LED. Each LED can be viewed as an ideal diode in series with a resistor. Increasing the voltage increases the current through the resistor, and hence, increases the heating of the photodiode. Hence, it is the average voltage that is important, not the instantaneous voltage. Accordingly, if the time period over which $V_d$ is exceeded is sufficiently small, $V_d$ can be exceeded without significant damage to the LEDs.

The longest period over which the array must be dark is the period in which the source voltage is below $V_f$. For a 120V AC source, this is 1.1 percent of the power cycle. For a 60-cycle source, this amounts to less than 100 microseconds per "dark" period. For many applications, this is too short to be perceived by a human observer. In the first scheme for dealing with the lack of overlap between the voltage ranges in the two exceptional transistors, the dark periods are of substantially less duration.

It should also be noted that the 96-LED array described above could be configured for use with a 240V full-wave rectified power source by adding four additional configurations. The additional configurations have the eight sub-arrays in series. The first configuration of each sub-array consists of 12 LEDs in series and covers the source voltage from the peak voltage at 312V down to 264V. The second configuration has five sub-arrays configured as 12 LEDs in series and three sub-arrays configured as two strings of six LEDs in series, the two strings being connected in parallel. This configuration covers the source voltage from 281V down to 215V. The third configuration has three sub-arrays configured as 12 LEDs in series and five sub-arrays configured as two strings of six LEDs as described above. This configuration covers the source voltage range from 237V down to 182V. The fourth configuration has one sub-array configured as 12 LEDs in series and seven sub-arrays configured as two strings of six LEDs as described above. This configuration covers the source voltage range from 194V down to 148V. The remaining voltage ranges are covered by the configurations discussed above with reference to Table 1 and FIGS. 10(*a*)-10(*p*). Hence, the same array can be utilized for both common AC power systems.

The above-described embodiments of the present invention have utilized the case of a variable power source that is a full-wave rectified AC source. However, the present invention may be used with any variable power source. Refer again to FIG. 4. In one aspect of the present invention, controller 52 includes a table, which provides a correspondence between each possible input voltage and a connection state for the various LEDs and LED array 51. When controller 52 senses a new voltage level from variable power source 54, controller 52 sets a corresponding connection state in LED array 51 such that as many of the LEDs as possible in LED array 51 are on. If it is not possible to have a state in which the LEDs are on and can absorb the full magnitude of the power from variable source 54, controller 52 causes voltage limiter 53 to reduce the voltage across LED array 51 or sets a configuration that is dark for a short period of time as described above. In essence, voltage limiter 53 and LED array 51 divide the voltage from variable power source 54 such that LED array 51 is not subjected to a voltage that is greater than LED array 51 can absorb in its current configuration.

While the present invention ideally provides a light source having N LEDs in which the light output is N times the average light output from a single LED as long as the driving voltage is greater than $V_f$, the present invention provides an advantage over the prior art even in those cases in which the light output is less than N times the average light output. If the input waveform is sinusoidal, output that closely approximates this ideal can be obtained. However for other waveforms, the output may be less than this because there is not a matching configuration of LEDs in which all of the LEDs are on and all of the input waveform is applied across the LED array. In one aspect of the present invention, the light source provides an output that does not vary by more than 10 percent from configuration to configuration when the driving voltage is greater than $V_f$. In other aspects of the present invention, the light source provides an output that does not vary by more than 20, 30, 40, or 50 percent from configuration to configuration when the driving voltage is greater than $V_f$.

The above-described embodiments of the present invention have been described in terms of a two-dimensional array of LEDs constructed from a nested array of sub-arrays. However, embodiments of the present invention that utilize other forms of two-dimensional arrays could also be constructed. For the purposes of this application, a two-dimensional array of LEDs is defined to be an array having a plurality of different configurations that present different numbers of LEDs in series and parallel between two power terminals, at least two of the configurations having different numbers of LEDs in parallel between the two power terminals. In contrast, a one-dimensional array of LEDs has all of the LEDs connected in series or parallel, the number of LEDs connected in series or parallel, respectively, changing from configuration to configuration.

The above described embodiments of the present invention utilize configurations in which all N LEDs generate light when the driving voltage is above $V_f$. However, embodiments in which a small number of the LEDs are off in one or more configurations still represent a substantial improvement over the art. For example, a sub-array of six LEDs in series could be configured to be an array with fewer than six LEDs generating light by using the switches in the structure shown in FIG. 8(*a*) to bypass one or more of the LEDs. Such an array can be useful in providing a $V_{min}$-$V_{max}$ range that is not easily obtained with all of the LEDs on. Consider an array having 36 LEDs. One method for providing an array with a $V_{min}=35*V_f$ would be to have 36 LEDs in series with one LED off. The resultant light loss is less than 3 percent; hence, this configuration may be satisfactory in cases where there is no other means for providing the $V_{min}$ in question without violating one of the other goals for the array. If a small fraction of the LEDs are allowed to be off in some configurations, arrays in which $V_{min}$ can be set to any integer multiple of $V_f$ can be obtained. In one aspect of the invention, no more than 10 percent of the LEDs are off in any of the configurations of the array.

As noted above, in principle, a sequence of configurations of a two-dimensional array of LEDs can be provided in which $V_{min}=I*V_f$, for I=1 to N, where N is the number of LEDs in the array. Also, as noted above, not all of these configurations are needed to track a particular driving voltage waveform such as a rectified AC power waveform. However, the use of the additional configurations could be advantageous. When the array is driven near to the $V_{max}$ associated with that array, the efficiency of conversion of electrical power to light is less than when the array is driven at voltages nearer to $V_{min}$, since a greater fraction of the energy is dissipated in heat. Hence, switching schemes in which the configuration is switched such that the driving voltage is maintained closer to the $V_{min}$ value can provide a greater electrical to light conversion efficiency. For example, in the scheme shown in Table 1, a configuration state having 24 LEDs in series could be inserted between configurations 4 and 5. This state would have $V_{min}=66$ and $V_{max}=86.4$. Hence, it would avoid the situation in which the configuration 5 is driven near its $V_{max}$ value when the array switches between configurations 4 and 5 as the driving potential is decreasing.

While the above-described embodiments contemplate a slowly varying driving potential such as that received from an AC source, the present invention can also compensate for voltage transients provided the transients are slow compared to switching time of the LED array, and provided the voltage limiter and controller can withstand the voltage transients in question. In this regard, the controller could include a voltage limiter such as a zener diode in parallel with the controller to limit the transients that must be absorbed by the LED array.

The above-described embodiments of the present invention have been provided to illustrate various aspects of the invention. However, it is to be understood that different aspects of the present invention that are shown in different specific embodiments can be combined to provide other embodiments of the present invention. In addition, various modifications to the present invention will become apparent from the foregoing description and accompanying drawings. Accordingly, the present invention is to be limited solely by the scope of the following claims.

What is claimed is:

1. A method for operating a light source comprising a two-dimensional reconfigurable LED array having a plurality of configurations of N LEDs, each configuration being characterized by a minimum bias potential and a maximum bias potential, said LED array generating light when a potential between first and second power terminals is greater than said selected forward bias potential, said method comprising providing a power source having a power potential that varies as a function of time;

measuring said power potential and reconfiguring said LED array in response to said measured power potential such that said forward minimum bias potential is less than said power potential when said power potential is greater than a predetermined threshold value and such that said measured power potential is less than said maximum bias potential for that configuration.

2. The method of claim 1 wherein said generated light varies in intensity by no more than 50 percent from configuration to configuration when said power potential is greater than said predetermined threshold.

3. The method of claim 1 wherein all of said LEDs generate light in each configuration in which said LED array generates light.

4. The method of claim 1 wherein at least 90 percent of said LEDs generate light in each configuration in which said LED array generates light.

5. The method of claim 1 further comprising limiting a voltage across said LED array from exceeding a limiting voltage, said limiting voltage being different from one of said configuration than said limiting voltage for another of said configurations, wherein said limiting voltage is chosen to prevent damage to one of said LEDs.

6. The method of claim 1 wherein said configurations are chosen such that no LED in said LED array draws more than 6 times the current of any other LED in said LED array in any of said configurations.

7. The method of claim 1 wherein said LED array comprises a plurality of identical sub-arrays, said sub-arrays being configurable in a plurality of different configurations.

8. The method of claim 1 wherein said power potential varies sinusoidally.

9. An apparatus comprising:

a power coupler configured to receive a power potential that varies as a function of time;

a reconfigurable two-dimensional LED array having a plurality of configurations of N LEDs, each configuration being characterized by a minimum bias potential and a maximum bias potential, said LED array generating light when a potential between first and second power terminals is greater than said minimum bias potential; and a controller that measures said power potential when said power is received by said apparatus and reconfigures said LED array in response to said measured power potential such that said minimum bias potential is less than said power potential when said power potential is greater than a predetermined threshold value and such that said measured power potential is less than said maximum bias potential.

10. The apparatus of claim 9 wherein said controller reconfigures said LED array such that said generated light varies in intensity by no more than 50 percent from configuration to configuration when said power potential is greater than said predetermined threshold.

11. The apparatus of claim 9 wherein said controller reconfigures said LED array based on a measure of the electrical to light conversion efficiency of each configuration for which said minimum bias potential is less than said power potential and said measured power potential is less than said maximum bias potential.

12. The apparatus of claim 9 wherein all of said LEDs generate light in each configuration in which said LED array generates light.

13. The apparatus of claim 9 wherein at least 90 percent of said LEDs generated light in each configuration in which said LED array generates light.

14. The apparatus of claim 9 comprising a voltage limiter that prevents a voltage across said LED array from exceeding a limiting voltage determined by said controller, said limiting voltage being different from one of said configuration than said limiting voltage for another of said configurations.

15. The apparatus of claim 9 wherein said configurations are chosen such that no LED in said LED array draws more than 6 times the current of any other LED in said LED array in any of said configurations.

16. The apparatus of claim 9 wherein said LED array comprises a plurality of identical sub-arrays, said sub-arrays being configurable in a plurality of different configurations.

17. The apparatus of claim 16 further comprising a switching network that connects said sub-arrays in a plurality of different configurations.

18. The apparatus of claim 17 wherein said sub-arrays comprise a plurality of LED sections arranged in a linear order, and first and second section buses, said LED sections comprising a first section, a plurality of intermediate sections, and a last section; said intermediate sections comprising first, second, and third switches and a light-emitting element having an anode and a cathode, said first switch connecting said anode to said first section bus, said second switch connecting cathode to said second section bus, and third LED connecting said section to an adjacent section.

19. The apparatus of claim 18 wherein said first section is connected to said first section bus and said last section is connected to said second section bus, said first and second sections comprising a light-emitting element and a switch for connecting that light-emitting element to one of said first and second section buses.

20. The apparatus of claim 9 wherein said power source comprises a full-wave rectified AC power source.

21. The apparatus of claim 9 wherein one of said configurations operates with a peak AC potential of greater than 320V and another of said configurations operates with a peak AC potential of less than 160V.

* * * * *